US006264425B1

(12) United States Patent
Keller

(10) Patent No.: US 6,264,425 B1
(45) Date of Patent: Jul. 24, 2001

(54) FLUID-FLOW MACHINE FOR COMPRESSING OR EXPANDING A COMPRESSIBLE MEDIUM

(75) Inventor: Jakob Keller, deceased, late of Wohlen (CH), by Maria Keller-Schärli, Vera Keller and Georg Keller, legal representatives

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/397,510

(22) Filed: Sep. 17, 1999

(30) Foreign Application Priority Data

Oct. 5, 1998 (EP) ..... 98810999

(51) Int. Cl.[7] ..... F01D 25/00
(52) U.S. Cl. ..... 415/58.7; 415/110
(58) Field of Search ..... 416/97 R; 415/110, 415/115, 168.2, 173.1, 171.1, 173.6, 176, 178, 54.1, 58.7, 914

(56) References Cited

U.S. PATENT DOCUMENTS 3,597,102 8/1971 Unsworth et al. .
4,752,185 6/1988 Butler et al. .
5,282,718 * 2/1994 Koff et al. ..... 415/57.3
5,308,225 * 5/1994 Koff et al. ..... 415/57.3
5,474,417 12/1995 Privett et al. .
5,493,855 * 2/1996 Walters et al. ..... 415/173.1
5,607,284 * 3/1997 Byrne et al. ..... 415/58.5
5,707,206 * 1/1998 Goto et al. ..... 415/173.1

FOREIGN PATENT DOCUMENTS

0497574A1 8/1992 (EP) .

* cited by examiner

*Primary Examiner*—Edward K. Look
*Assistant Examiner*—Ninh Nguyen
(74) *Attorney, Agent, or Firm*—Burns, Doane, Swecker & Mathis, L.L.P.

(57) ABSTRACT

A fluid-flow machine for compressing or expanding a compressible medium is described, having a rotor on which there is arranged perpendicularly to the rotor axis at least one moving-blade row, the individual moving blades of which have moving-blades ends, which are free on the radial side and face the inner wall of a casing, surrounding the rotor, in a freely movable manner, through the interior space of which casing the compressible medium flows axially relative to the rotor axis. An annular-passage system is open to receive the compressible medium on either side of the moving-blade row and the flow in the interior of the casing, and in a modified form may have surface contours on the ends of the blades to create pressure conditions which correspond approximately to the static pressure conditions at the opposite sides of the blades.

11 Claims, 4 Drawing Sheets

FLUID-FLOW MACHINE FOR COMPRESSING OR EXPANDING A COMPRESSIBLE MEDIUM

FIELD OF THE INVENTION

The invention relates to a fluid-flow machine for compressing or expanding a compressible medium.

BACKGROUND OF THE INVENTION

Fluid-flow machines of the abovementioned generic type are designed as rotary machines and have moving-blade elements along their axis of rotation, the free moving-blade ends of which face the inner wall of the fluid-flow casing in a freely movable manner. In the case of rotary machines through which the medium to be compressed flows axially relative to the rotor axis, guide-blade plates are normally attached firmly on one side to the inner wall of the casing of the rotary machine and their free end stands freely opposite corresponding contours on the rotor shaft. An essential aspect in the optimization of the compression efficiency or the turbine efficiency of such rotary machines is the reduction of leakage flows, i.e. of flow components, of the compressible medium flowing through the rotary machine, which pass through between the moving-blade ends or guide-blade ends and the contours opposite said ends. So-called labyrinth seals are used in order to reduce or avoid such leakage flows, these labyrinth seals comprising a multiplicity of intermeshing contours, which are able to seal, in a virtually gastight manner, the intermediate spaces between the rotating parts and the fixed casing parts together with guide blade. Thus the leakage flow can be reduced considerably when using labyrinth seals by virtue of the fact that the labyrinth seals themselves are provided with a multiplicity of individual sealing lips, but the disadvantage attached to this form of seal is that, the more labyrinth seals are provided in the interior of a rotary machine and these seals comprise a multiplicity of individual sealing lips, the greater become the frictional forces which, for example, act peripherally from outside on the rotating moving blades, as a result of which the mechanical loading of the rotating parts inside a rotary machine is increased. In addition, it is only rarely possible to accommodate a sufficient number of labyrinth elements for a high sealing effect.

Another solution for the reduction of leakage flows has been pursued in radial-compressor arrangements.

FIG. 2*a* shows a cross section through a radial compressor, which has a central rotor shaft 5, which is arranged in the interior of the casing 4 of the radial compressor. Connected to the rotor shaft 5 is a nozzle-like contour 11, through which, in the course of the rotation, preferably air is driven from inside to outside through the nozzle opening 12 by the centrifugal acceleration. Provided opposite the nozzle opening 12 of the contour 11 inside the casing 4 is an outlet opening 13, through which the compressed air leaves the radial compressor. In order to prevent leakage flows from escaping between the contour 11 and the inner casing 4 through the intermediate spaces 14, no labyrinth seals are provided, as in the case described above for axial compressors, but rather the fixed casing is deliberately spaced apart from the rotating contour 11 by a gap, so that a leakage flow could occur in principle. However, in order to reduce the leakage flow despite the existing gap, ribs 15 raised above the contour 11 are attached to the outside of the contour 11 (in this respect see FIG. 2*d*, from which a sectional drawing along section line A—A is depicted in developed form), and these ribs 15, on account of their radial movement, induce an annular flow in the intermediate spaces 14, and this annular flow creates inside the intermediate spaces 14 static pressure conditions which correspond to the pressure conditions which prevail in the region of the connecting gaps within the main flow. Due to such a pressure balance between the interior of the intermediate spaces 14 and the main flow, any leakage flows largely cease.

Although a certain proportion of rotary energy must be invested in the generation of an annular flow required in the interior of the intermediate spaces 14, tests and measurements show that an expenditure of energy in this respect is below the energy which is mainly lost through leakage when using labyrinth seals.

SUMMARY OF THE INVENTION

Accordingly, one object of the invention is to provide an axial-compressor arrangement or axial-turbine arrangement, in such a way that the leakage flow is to be minimized while dispensing with the use, known per se, of labyrinth seals, in which case the adverse frictional effects in labyrinth seals, which not least lead to increased material stresses in the guide blades and moving blades and limit their service life, are to be eliminated. On the contrary, in accordance with the measure known in radial compressors for the reduction of leakage flows, a practicable solution for reducing the leakage flow largely free of contact between the rotating and fixed components of the rotary machine is to be found.

According to the invention, a fluid-flow machine for compressing or expanding a compressible medium, having a rotor on which there is arranged perpendicularly to the rotor axis at least one moving-blade row, the individual moving blades of which have moving-blade ends, which are free on the radial side and face the inner wall of a casing surrounding the rotor, through the interior space of which casing the compressible medium flows axially relative to the rotor axis, is of such a design that an annular-passage system is provided inside the casing, surrounding the rotor, in such a way as to be directly radially opposite the free ends of the moving blades of a moving-blade row. The annular-passage system preferably extends inside the casing of the fluid-flow machine radially around the entire peripheral circumferential margin of a moving-blade row. That region of the annular-passage system which is opposite the moving-blade ends is designed to be open on one side and is bounded by the moving-blade ends in such a way that on either side of a moving-blade row there respectively remains an opening passage, through one opening passage of which the compressible medium, preferably air, flows out of the interior space of the casing, through which the air flows axially, into the interior of the annular-passage system, and through the second opening passage the air discharges out of the annular-passage system into the interior space of the casing again. The abovementioned opening passages correspond in the above case to the intermediate gaps between the rotating and fixed components of the turbine arrangement or compressor arrangement.

To generate an annular flow flowing inside the annular-passage system, the annular-passage system as well as the moving-blade ends, at least in regions which are adjacent to the opening passages, have surface contours which, at those points inside the annular-passage system where the opening passages open out, create pressure conditions which arise due to the formation of a dynamic annular flow inside the annular-passage system and correspond approximately to the static pressure conditions which prevail in the interior space of the casing respectively in the region of the opening passages.

Thus the annular flow is preferably produced inside the annular-passage system in such a way that a small proportion of the compressible medium, preferably air, passing axially through the rotary machine passes through into the opening passage between moving-blade end and casing, preferably through the opening passage which is provided upstream of the moving blade in the direction of flow and, just before the inlet into the annular-passage system, has a flow inner contour which is designed in such a way that the flow passing through the opening passage enters the annular passage with a preferred direction. In this way, an annular flow can be induced inside the annular-passage system opposite the moving-blade ends, and this annular flow produces the desired pressure conditions after appropriate design of the inner contour of the annular-passage system. To this end, the moving-blade ends each have a shroud, in which the surface contour is made, and this surface contour is directly opposite the annular-passage system.

The idea underlying the invention is that the flow loss inside the annular-passage system during the operation of the rotary machine is to be as small as possible. To this end, it is necessary to adapt the pressure conditions inside the annular-passage system and the interior space of the fluid-flow machine in the regions of the opening passages. The static pressure conditions in the interior space of the fluid-flow machine are preset by the dimensioning and output capacity of the machine itself. Consequently, the annular-passage system must be designed in such a way that the preset static pressure conditions prevailing in the interior space in the region of the opening passages are also produced in the annular-passage system itself.

In order to be able to bring this about, the cross section of flow inside the annular-passage system, in particular in the region of the opening passages, is reduced in size in relation to the cross section of flow of the remaining regions inside the annular-passage system, so that, on account of a local nozzle effect, there is a pressure balance between the interior of the annular passage and the interior of the fluid-flow casing.

In addition to the air flow entering the annular passage due to the flow dynamics of the rotary machine, cooling passages may be provided specifically, either in the casing of the rotary machine and/or in the moving blades, through which cooling passages cooling air can be fed specifically into the annular-passage system, in which case, by a certain preset selection of the inlet angle of the cooling line into the annular-passage system, both the direction and the flow velocity of the annular flow occurring inside the annular passage can be preset or influenced.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE INVENTION

Figure 1:
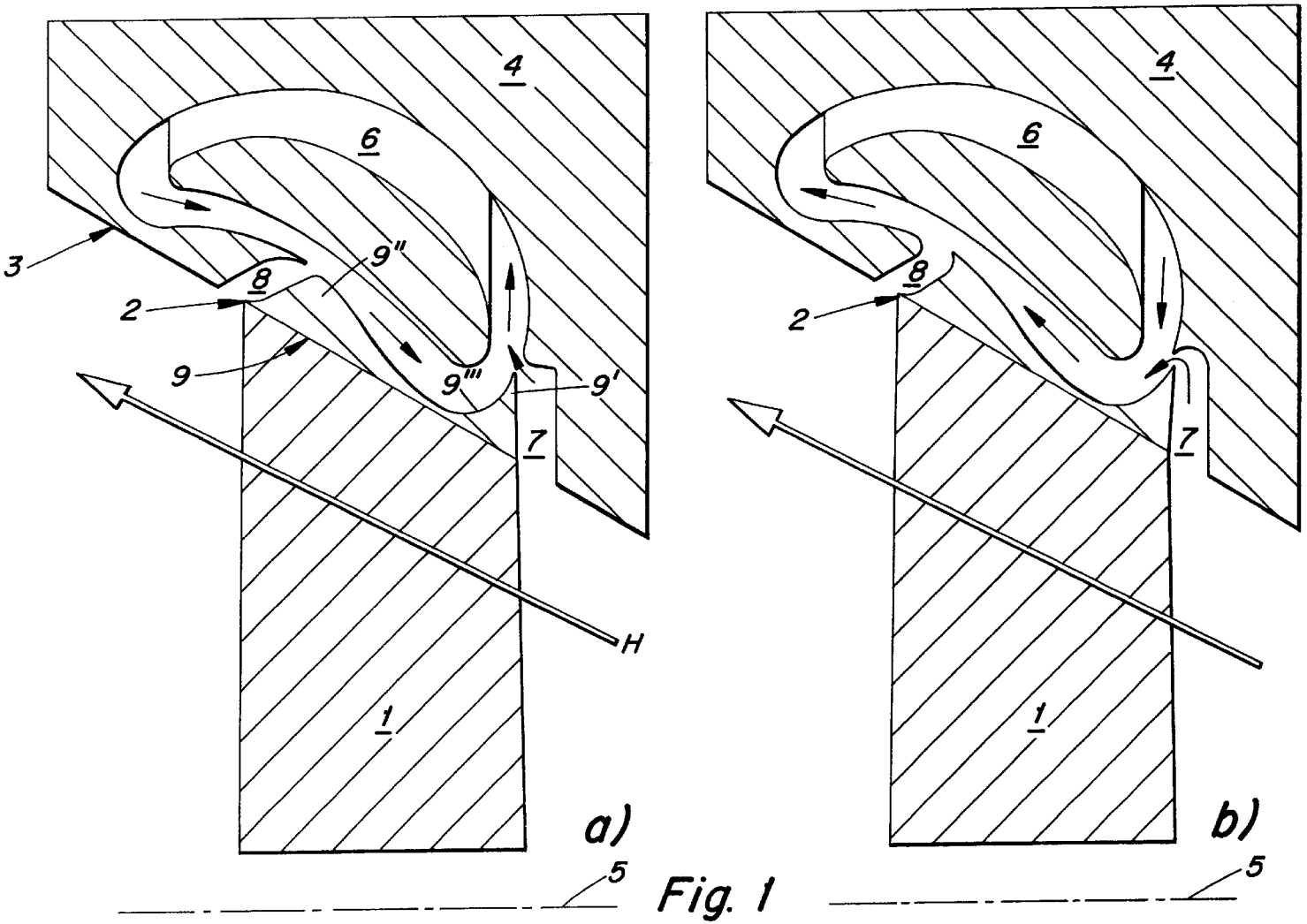
FIG. 1 is a schematic cross-sectional view of a rotary machine in accordance with this invention having an annular casing and a moving blade moving blade showing operating conditions at (a) and at (b)
Figure 2:
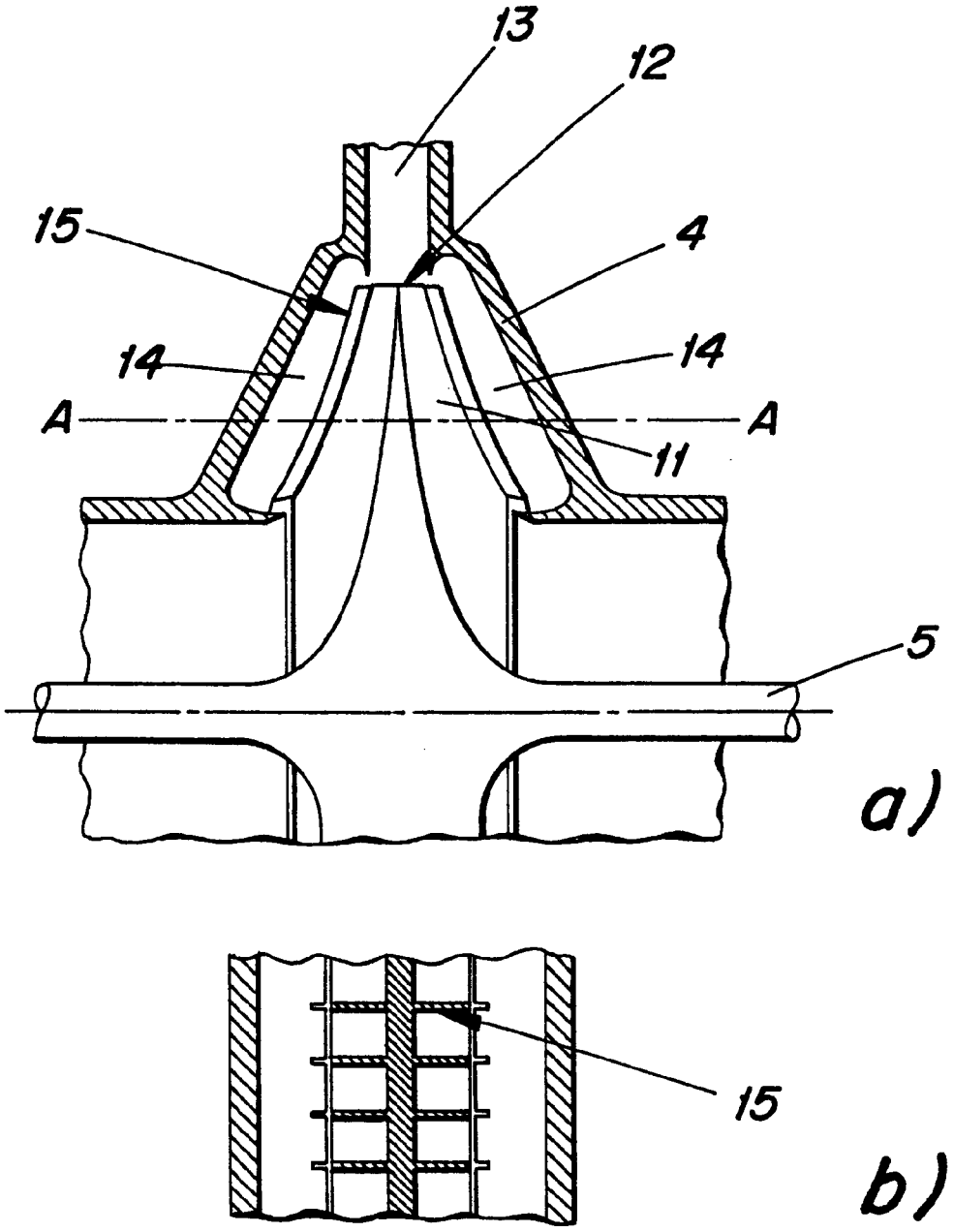
Fig. 2 PRIOR ART
FIG. 2 is a radial cross-sectional view of a prior art rotary machine at (a) and a circumferential cross-sectional view of a prior art rotary machine.

Referring now to the drawings, wherein like reference numerals designate identical or corresponding parts throughout the several views, the formation of the annular flow inside the annular passage 6, which mainly runs in the casing 4 and is defined on one side by the moving-blade-wheel ends 2, is to be described with reference to FIGS. 1*a* and *b*.

In both representations of FIGS. 1*a* and *b* , the air to be compressed passes through the fluid-flow machine (shown in partial cross section) from right to left (see arrow). In the process, the moving blade 1 rotates about the rotor axis 5. The moving-blade end 2 has a shroud 9 with a surface contour which is of S-shaped design and corresponds approximately to the opposing contour of the inner wall of the annular passage 6 in this region. Provided in the region of the casing on that side of the moving blade 1 which faces the main flow H is an inlet-opening passage 7, through which air can enter the interior of the annular passage 6. In this case, the contour of the inlet-opening passage 7 is formed in the region of the transition into the annular passage 6 in such a way that the incoming flow is passed with a preferred direction into the annular passage. Depending on the curvature of the inlet contour inside the inlet-opening passage 7 in the direction of the annular passage 6, the annular-passage flow may be oriented counter-clockwise (in this respect (see FIG. 1*a*) or clockwise (in this respect see FIG. 1*b*).

In order to provide a pressure balance between the interior of the annular passage 6 and the interior space of the fluid-flow machine in the region of the inlet-opening passage 7 so that the leakage flow which would form due to the intermediate gap between the moving-blade end 2 and the casing 4 is limited, the annular passage 6 in this section is designed as a diffuser, so that the annular flow flows over the inlet-opening passage at relatively low flow velocities, as a result of which a high dynamic pressure forms, and this dynamic pressure corresponds approximately to that which prevails in the interior space of the rotary machine before entry into the inlet-opening passage 7. In particular, the inlet-opening passage 7 opens inside a curved annular-passage profile into the annular passage 6 and in particular in the region of the curved outer wall of the annular passage, in which the pressure increase forms to an especially intense degree.

The opposite is the case with the design of the inner contour of the annular passage in the region of the outlet-opening passage 8, in which the annular passage is designed in the direction of flow as a nozzle contour, through which the annular flow is accelerated, as a result of which the pressure prevailing in the annular passage drops in such a way that it corresponds approximately to the external pressure inside the interior space of the rotary machine in the region of the outlet-opening passage 8. The outlet-opening passage 8 enters the annular passage in particular in an annular-passage wall section of concave design in order to lie fluidically in the region of the lowest pressure prevailing in the annular passage. A pressure gradient which is oriented laterally to the direction of flow and increases in the direction of the inner wall of convex design is produced by the curved profile of the annular passage in the region of the outlet port 8.

In order to be able to set the above pressure conditions in a suitable manner, the S-shaped contour on the moving-blade end 2 has a contour section 9' projecting into the interior of the casing 4, a convex section 9" and a concave section 9'". The contour sections 9', 9" and 9'" are designed as projecting blade ribs, which rise from the plane of the moving-blade end 2 and project into the annular-passage system 6.

Figure 3:
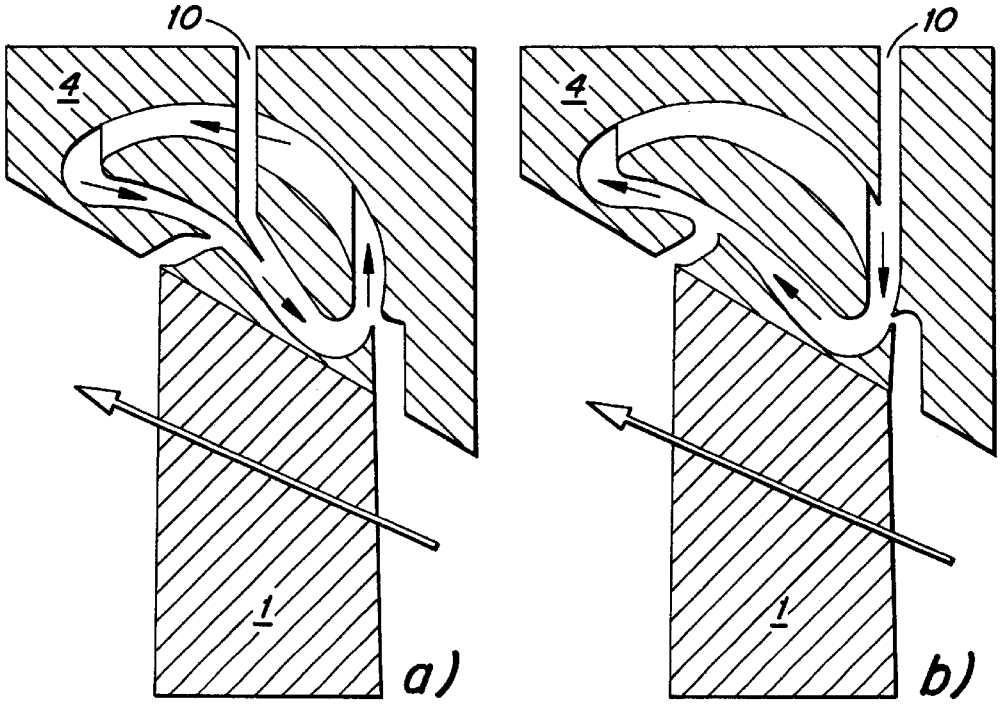
FIG. 3 is a cross-sectional view of an annular passage in the chamber casing, showing operating conditions at (a) and (b).

Shown in FIGS. 3*a* and 3*b* are cross-sectional representations through an annular-passage system which in each case is supplied with cooling air through an additional cooling passage 10 provided in the casing 4. Depending on the inlet direction of the cooling-supply-air flow entering the annular passage 6, the flow velocity of the annular flow inside the annular passage 6 as well as its direction of flow may be influenced. In the case of FIG. 3*a*, the cooling passage enters the annular passage 6 in such a way that an intensified counter-clockwise annular flow forms. A corresponding arrangement for the formation of a clockwise annular flow is shown in FIG. 3*b*. In addition to the direct influencing of the dynamic flow behavior of the annular flow inside the annular passage 6, the cooling air is able to specifically cool both the casing 4 and the blade-body tip regions of the moving blades 1, as a result of which the thermal loading of the individual components can be reduced.

Figure 4:
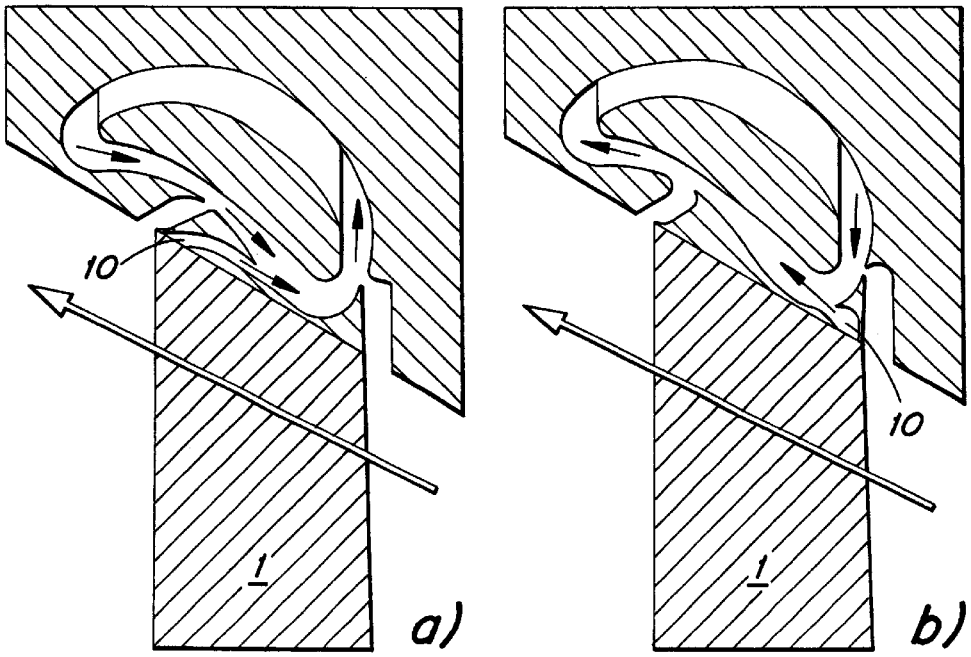
FIG. 4 is a schematic cross-sectional representation through an annular passage system in accordance with this invention, showing operating conditions at (a) and at (b)

In FIGS. 4*a* and 4*b*, the moving blade 1 in each case has a cooling outlet passage 10, which, depending on its inlet direction into the cooling passage 6, can influence the annular flow with regard to its direction of flow and flow velocity. The embodiments according to FIGS. 4*a* and *b* may of course be combined with a cooling system 10, passing through the casing 4, according to the exemplary embodiment 3*a, b*.

Due to the design according to the invention of the annular-passage system inside the casing 4, which completely encircles the casing 4 radially and is arranged respectively opposite the moving-blade rows, the leakage flow which normally forms in the intermediate space between the moving-blade ends and the casing can be reduced considerably without having to tolerate noticeable frictional losses, as form in axial fluid-flow machines when using labyrinth seals. Through the use of additional cooling-passage systems, which, in addition to cooling purposes known per se, serve for specifically supplying the annular flow with cooling air, a precisely proportioned pressure adaptation can be set between the regions described above inside the annular passage, as a result of which the leakage flow ceases virtually completely.

Figure 5:
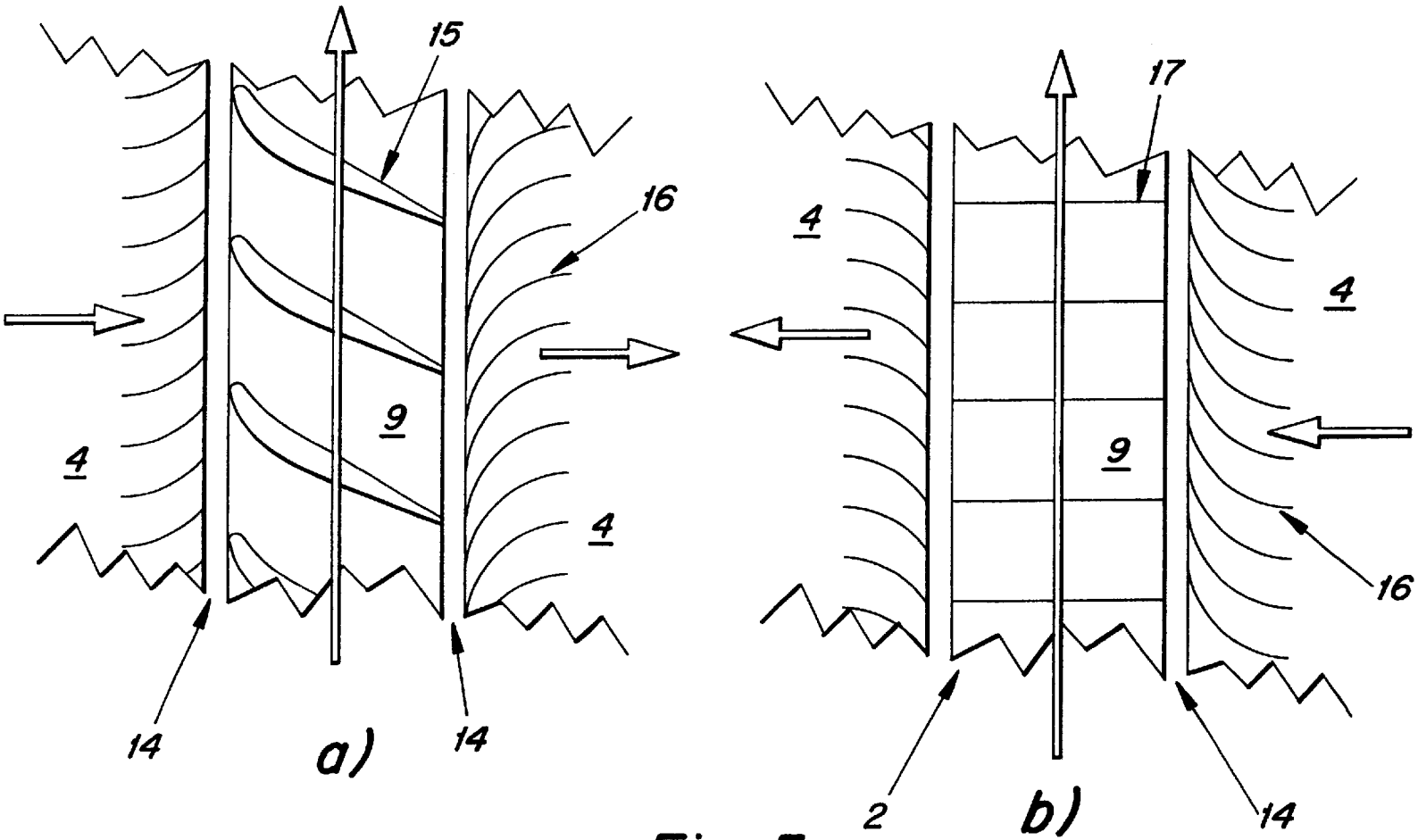
FIG. 5 is a circumferential cross-sectional view of an annular passage system, showing operating conditions at (a) and (b).

Different embodiments of the shroud 9 on a moving blade 2 are shown in FIGS. 5*a* and *b*. In FIG. 5*a*, a plurality of small moving-blade bodies 15, which rise above the moving-blade end 2 and extend into the annular passage 6, are provided on the moving-blade end 2. The representation corresponds to the view inside the annular passage toward the shroud 9 of the moving-blade end 2. Spaced apart by an intermediate space 14 in each case, the casing 4 is adjacent to the moving blade on the left and right. Adjacent to the intermediate spaces 14, the casing 4 likewise has ribs 16, which guide the annular flow inside the annular passage 6. In the case of FIG. 5*a*, the annular flow is oriented from left to right and essentially corresponds to the exemplary embodiment according to FIG. 1*a*.

In FIG. 5*b*, rectilinear ribs 17, which project into the interior of the annular-passage system, are located on the moving-blade end 2. Deflecting elements in the form of curved ribs 16 are again provided on the casing 4, only in the opposite orientation to the case of the embodiment in FIG. 5*a*. The direction of flow of the annular flow, by way of comparison with FIG. 1*b*, is now oriented from right to left.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A fluid-flow machine for compressing or expanding a compressible medium, comprising a rotor with an axis on which there is a arranged perpendicularly to the rotor axis at least one moving-blade row, the individual moving blades of which have moving-blade ends which are free on a radial side and face an inner wall of a casing, surrounding the rotor, in a freely movable manner, through an interior space of which casing the compressible medium flows axially relative to the rotor axis, which an annular-passage system is provided inside the casing, surrounding the rotor, in which a way as to be directly radially opposite the free ends and bounded by the moving-blade ends and respectively has on either side of the moving-blade row an opening passage, through one opening passage of which the compressible medium flows out of the interior space of the casing into the interior of the annular-passage system, and through the second opening passage the compressible medium discharges out of the annular-passage system into the interior space of the casing, and wherein the annular-passage system as well as the moving-blade ends, at least in regions which are adjacent to the opening passages, having surface contours which, at those points inside the annular-passage system where the opening passage open out, create pressure conditions which arise due to the formation of a dynamic annular flow inside the annular-passage system and correspond approximately to the static pressure conditions which prevail in the interior space of the casing respectively in the region of the opening passages.

2. The fluid-flow machine as claimed in claim 1, wherein a shroud is provided on the moving-blade end, in which shroud the surface contour is made, which surface contour is designed approximately as the opposing contour of the surface contour of the annular-passage system in the region designed to be open on one side.

3. The fluid-flow machine as claimed in claim 1, wherein the opening passage through which the compressible medium flows into the annular-passage system is bounded on the one side by a counter section of the moving-blade end, this contour section projecting into a recess inside the casing, and on the other side by the casing.

4. The fluid-flow machine as claimed in claim 3, wherein the opening passage, at the location of the inlet into the annular-passage system, provides an inner contour which results from the profiling of the contour section of the moving-blade end and of the casing and which gives the compressible medium flowing into the annular-passage system a preferred direction of flow inside the annular-passage system, and this preferred direction of flow determines the direction of flow of the annular flow.

5. The fluid-flow machine as claimed in claim 1, wherein the shroud of the moving-blade end is of S-shaped design and has a convex section and a concave section, and wherein the convex section is adjacent to the opening passage through which the compressible medium discharges from the annular-passage system, and the concave section is adjacent to the opening passage through which the compressible medium flows into the annular-passage system.

6. The fluid-flow machine as claimed in claim 1, wherein the annular-passage system has a constriction of the cross-section of flow in the direction of flow of the annular flow upstream of the opening passage, through which the compressible medium discharges, and has an enlargement of the cross section of flow downstream of the opening passage.

7. The fluid-flow machine as claimed in claim 1, wherein the opening passage through which the compressible medium discharges from the annular-passage system opens into the annular-passage system in a region in which the annular passage at a point of maximum possible curvature.

8. The fluid-flow machine as claim in claim 1, wherein the opening passage through which the compressible medium enters the annular-passage system opens out in a region of the annular-passage system in which the annular passage has a curved profile, and wherein the opening passage, in this region, opens into the annular passage at a point of minimum possible curvature.

9. The fluid-flow machine as claimed in claim 1, wherein a cooling-passage system is provided inside the casing, and this cooling-passage system is connected to the annular-passage system in such a way that a direction of flow of the annular flow can be predetermined by the inlet direction, relative to the course of the annular passage, with which the cooling system opens into the annular-passage system.

10. The fluid-flow machine as claimed in claim 1, wherein a cooling-passage system is provided inside the moving blade, and this cooling-passage system opens into the annular-passage system via the moving-blade end.

11. The fluid-flow machine as claimed in claim 1, wherein the annular-passage system in the casing is designed in a closed encircling form radially to the moving blades.

* * * * *